US005193743A

United States Patent [19]

Romann et al.

[11] Patent Number: 5,193,743

[45] Date of Patent: Mar. 16, 1993

[54] DEVICE FOR INJECTING A FUEL-GAS MIXTURE

[75] Inventors: Peter Romann, Stuttgart; Waldemar Hans, Bamberg, both of Fed. Rep. of Germany

[73] Assignee: Robert Bosch GmbH, Stuttgart, Fed. Rep. of Germany

[21] Appl. No.: 883,329

[22] Filed: May 14, 1992

[30] Foreign Application Priority Data

May 31, 1991 [DE] Fed. Rep. of Germany ..... 4117810
Jun. 28, 1991 [DE] Fed. Rep. of Germany ..... 4121372

[51] Int. Cl.[5] ..... F02M 57/00; F02M 43/00; F02M 69/04

[52] U.S. Cl. ..... 239/1; 239/409; 239/417.3; 239/424; 239/424.5; 239/585.5; 123/531

[58] Field of Search ..... 239/1, 407–410, 239/417.3, 423–424.5, 426, 433, 434, 553.12, 585.3–585.5; 123/531

[56] References Cited

U.S. PATENT DOCUMENTS 2,969,784 1/1961 High .
3,680,794 8/1972 Romann et al. ..... 239/585.4
4,545,354 10/1985 Jaggle et al. ..... 123/531

FOREIGN PATENT DOCUMENTS 896738 6/1954 Fed. Rep. of Germany .
143160 8/1983 Japan .

*Primary Examiner*—Andres Kashnikow
*Assistant Examiner*—Karen B. Merritt
*Attorney, Agent, or Firm*—Edwin E. Greigg; Ronald E. Greigg

[57] ABSTRACT

A device for injecting a fuel-gas mixture having a cup-shaped gas enveloping sleeve in which the cylindrical part of the gas enveloping sleeve permits exact centering of the gas enveloping sleeve relative to the fuel injection valve. The novel device while having very exact centering of the gas enveloping sleeve relative to the fuel injection valve has the advantage of a simple, economical manufacture. The device includes radially inwardly pointing guide strips that rest with their face ends on the circumference of the fuel injection valve and thus in a simple way center the gas enveloping sleeve relative to the fuel injection valve. The device for injecting a fuel-gas mixture is especially well-suited for injection of a fuel gas mixture into the intake tube of a mixture-compressing internal combustion engine with externally supplied ignition.

14 Claims, 5 Drawing Sheets

DEVICE FOR INJECTING A FUEL-GAS MIXTURE

BACKGROUND OF THE INVENTION

The invention relates to a device for injection a fuel gas mixture and to a method for producing a device for injecting a fuel-gas mixture. German Patent Application 32 40 554 Al already discloses a device for injecting a fuel-gas mixture in the form of a throttle-pintle fuel injection valve with a cup-shaped gas enveloping sleeve, the injection port of which is surrounded in the immediate vicinity of the gas guide sleeve by an annular gas gap communicating with an annular gas conduit. At least one axially extending, groove-like gas guide conduit that is defined by the circumference of the fuel injection valve, discharges into the annular gas conduit, and which serves to deliver the gas to the injection port of the fuel injection valve is disposed in the cylindrical part of the gas enveloping sleeve. With its inner wall, the cylindrical part of the cup-shaped gas enveloping sleeve rests on the circumference of the fuel injection valve, so that in this way the gas enveloping sleeve is centered relative to the fuel injection valve. This kind of cup-shaped gas enveloping sleeve, with axial gas guide conduits embodied as grooves in the inner wall of the cylindrical part, is complicated in structure and expensive to manufacture. If the functionally necessary exact centering of the gas enveloping sleeve relative to the fuel injection valve is to be assured, then very close manufacturing tolerances must be adhered to, which makes for expensive production.

OBJECT AND SUMMARY OF THE INVENTION

The device according to the invention for injecting a fuel-gas mixture is very simple and economical to produce. The guide strips, pointing radially inward and resting on the circumference of the fuel injection valve, assure simple, exact centering of the gas enveloping sleeve relative to the fuel injection valve.

The method according to the invention for producing a device for injection of a fuel-gas mixture has the advantage of a very simple and economical embodiment of the guide strips and through openings.

For particularly simple delivery of the gas to the at least one injection port of the fuel injection valve, it is advantageous if at least one through opening is formed in the cylindrical part of the gas enveloping sleeve.

In a further feature of the invention, the guide strips are formed simultaneously with the through openings. Moreover, axial gas guide conduits are formed very simply between each two adjacent guide strips; the gas can flow through these conduits toward the at least one injection port of the fuel injection valve.

To facilitate slipping the gas enveloping sleeve onto the valve end of the fuel injection valve and to prevent damage to the circumference of the valve end from the guide strips, it is advantageous if the guide strips are embodied as rounded in the direction remote from the bottom part.

It is advantageous if the gas enveloping sleeve is secured to the circumference of the valve end by means of several spot welds or a crimped edge, so that a firm hold of the gas enveloping sleeve on the valve end of the fuel injection valve is assured.

For simple, secure mounting of a sealing ring on the gas enveloping sleeve, it is advantageous if a retaining ring with a U-shaped cross section that opens radially outward is disposed on the circumference of the gas enveloping sleeve.

For particularly fine fuel atomization, it is advantageous if a narrow annular gas gap is formed axially between the valve end of the fuel injection valve and the bottom part of the gas enveloping sleeve.

For the same reason, it is also advantageous if the fuel injection valve rests with its valve end on the bottom part of the gas enveloping sleeve and if at least one gas delivery opening, which extends in inclined fashion relative to the longitudinal valve axis in the fuel flow direction, is formed in the bottom part.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
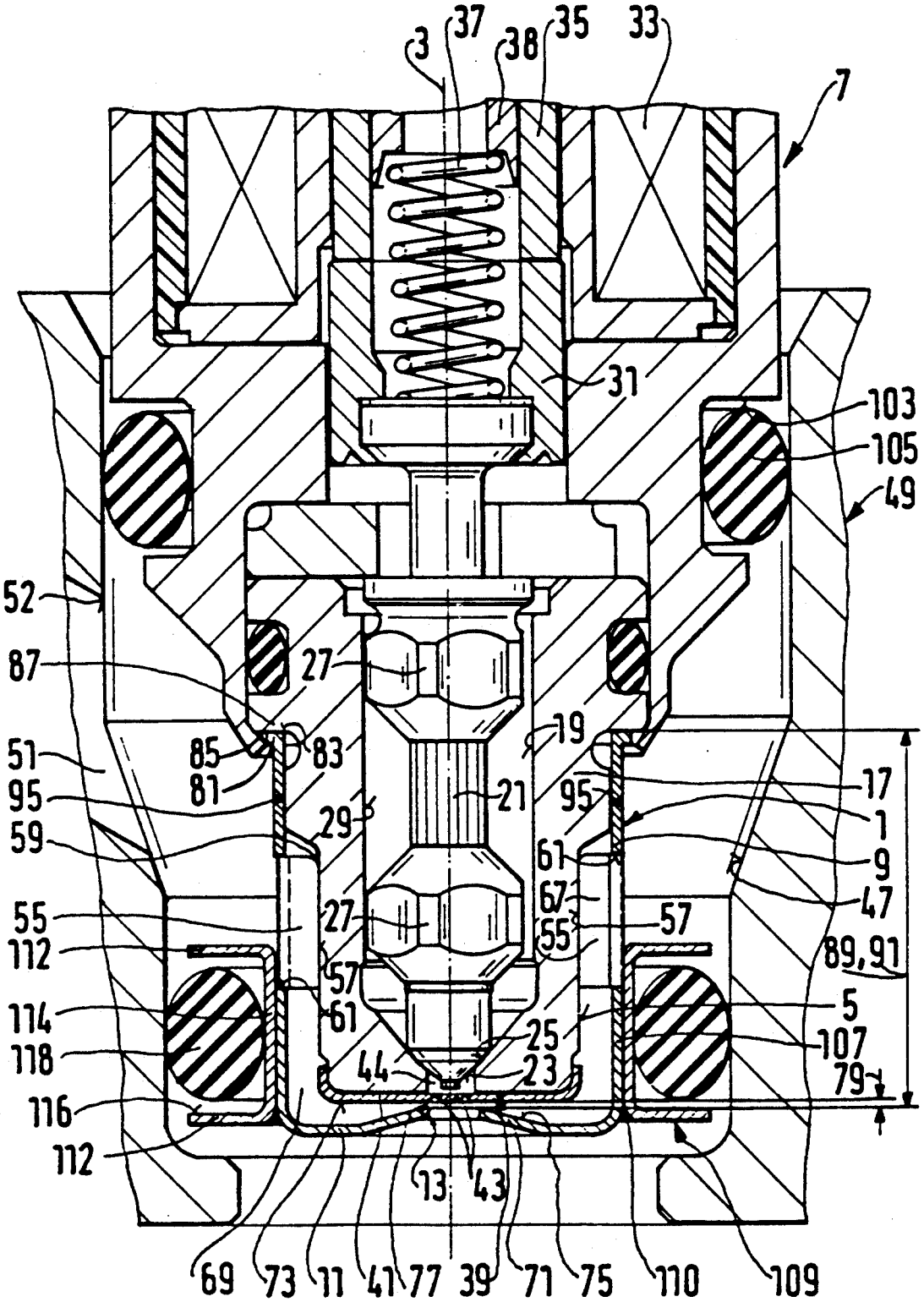
FIG. 1 is a fragmentary view of a device for injecting a fuel-gas mixture in accordance with a first exemplary embodiment of the invention.
Figure 4:
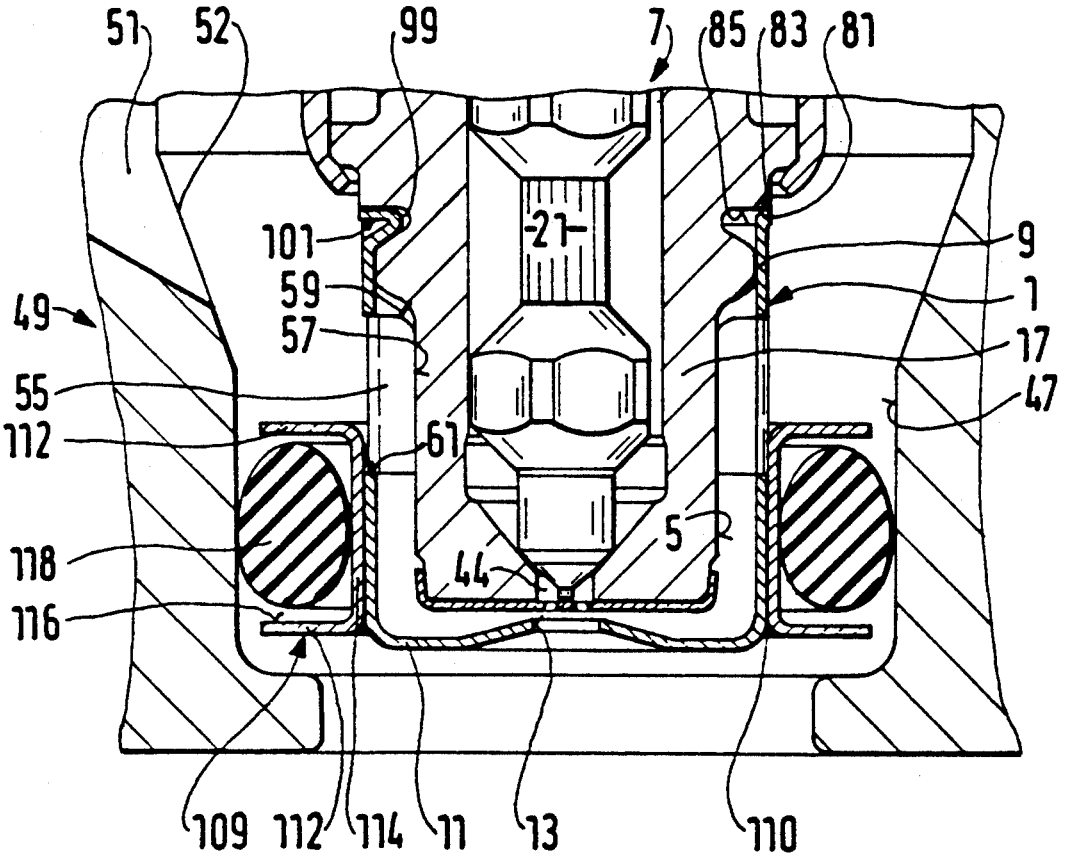
FIG. 4 is a fragmentary view of a device for injecting a fuel-gas mixture in accordance with a second exemplary embodiment of the invention.
Figure 7:
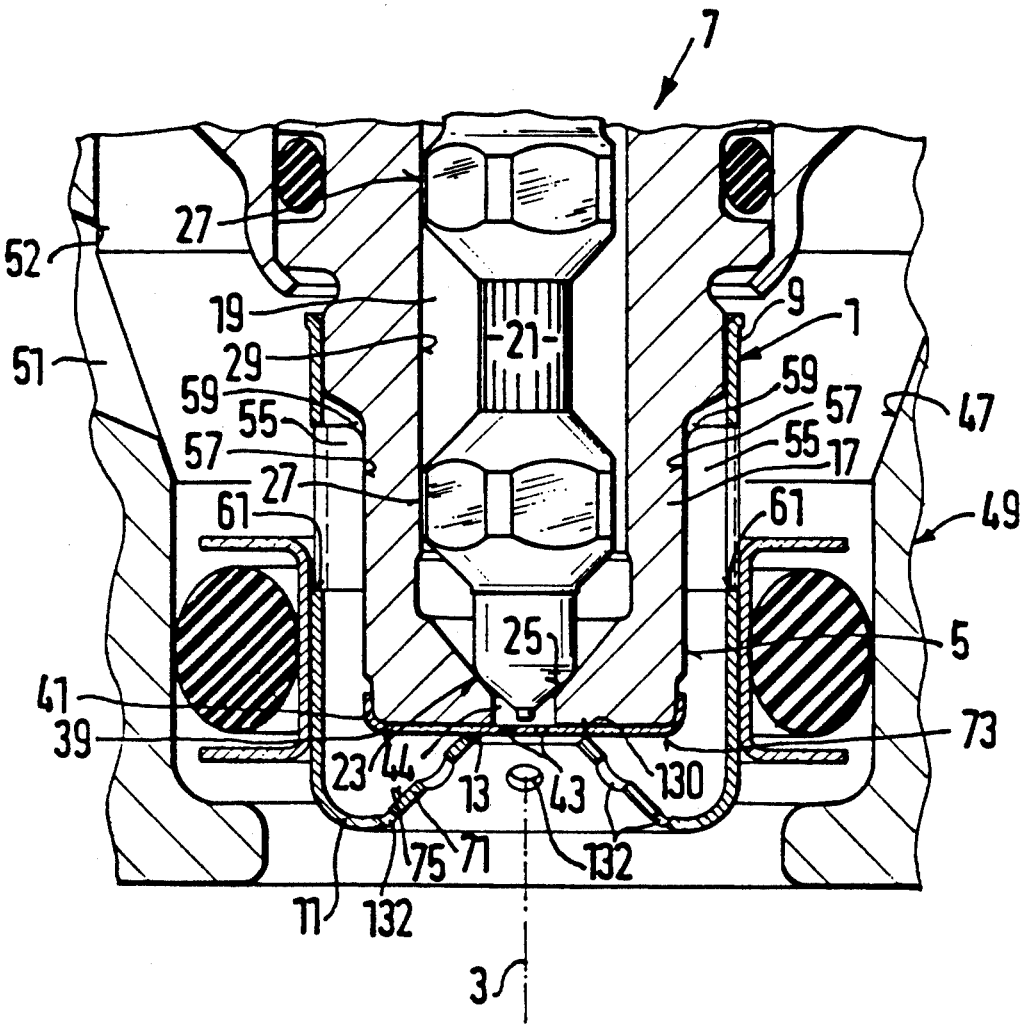
FIG. 7 is a fragmentary view of a device for injecting a fuel-gas mixture, in accordance with a fourth exemplary embodiment of the invention.

The devices for injecting a fuel-gas mixture, for instance into a mixture-compressing internal combustion engine having externally supplied ignition, that are shown in part and by way of example in FIGS. 1, 4 and 7 comprise a cup-shaped gas enveloping sleeve 1 that encompasses a valve end 5 of a fuel injection valve 7 concentrically with a longitudinal valve axis 3. The gas enveloping sleeve 1 surrounds the valve end 5 of the fuel injection valve 7 at least partially axially, with a cylindrical part 9, and at least partially radially, with a bottom part 11. The bottom part 11 of the gas enveloping sleeve 1 has a through opening 13 that for instance extends concentrically with the longitudinal valve axis 3.

The electromagnetically actuatable fuel injection valve 7, shown in fragmentary form and by way of example in FIGS. 1, 4 and 7, has a nozzle body 17 that extends as far as the valve end 5 and serves as part of a valve housing. A stepped longitudinal opening 19 is formed in the nozzle body 17, extending concentrically with the longitudinal valve axis 3. A valve closing part 21 is disposed in the longitudinal opening 19; with its one sealing segment 23, facing toward the bottom part 11 of the gas enveloping sleeve 1 and tapering frustoconically in the fuel flow direction, it cooperates with a fixed valve seat 25, tapering frustoconically in the fuel flow direction, of the longitudinal opening 19 of the nozzle body 17. The valve closing element 21 has guide segments 27, two of them for example, which together with a guide region 29 of the wall of the longitudinal opening 19 of the nozzle body 17 serve to guide the valve closing part 21. On its end remote from the sealing segment 23, the valve closing part 21 is connected to an armature 31, which cooperates with a magnet coil 33, partially surrounding the armature 31 axially, and an inner pole 35 of the fuel injection valve 7 opposite the armature 31 in the direction remote from the fixed valve seat 25. A restoring spring 37 rests on the end of the valve closing part 21 connected to the armature 31, and on its other end is supported on an adjusting sleeve 38 inserted into the inner pole 35; the restoring spring 37 urges the valve closing part 21 toward the fixed valve seat 25.

A small perforated plate 41 rests directly on a face end 39, oriented toward the bottom part 11 of the gas enveloping sleeve 1, of the valve end 5 of the fuel injection valve 7. The perforated plate 41 has injection ports 43, for example two of them, through which the fuel, flowing past the fixed valve seat 25 when the valve closing part 21 is raised and reaching a terminal conduit 44 of the longitudinal opening 19, is injected.

The devices according to the invention, shown by way of example in FIGS. 1, 4 and 7, can be installed for instance in a stepped valve receiving opening 47 of an intake tube 49 of the engine, which for instance has a plurality of spaced-apart valve receiving openings 47. A gas delivery conduit 51, which serves to deliver a gas to the gas enveloping sleeve 1, discharges into each of the valve receiving openings 47 at an inlet opening 52 and is inclined obliquely toward the valve end 5. As the gas, the aspirated air, diverted through a bypass upstream of a throttle valve in the intake tube 49 of the engine, or air furnished by an additional blower, or recirculated engine exhaust gas, or a mixture of air and exhaust gas may be used. The use of recirculated exhaust gas makes it possible to reduce polluting engine emissions.

At least three and in the exemplary embodiments of FIGS. 1, 4 and 7, for instance eight radially inwardly pointing guide strips 55, spaced apart equally from one another in the circumferential direction, are formed on the cylindrical part 9 of the gas enveloping sleeve 1. With its face end 57 toward the nozzle body 17, extending axially parallel to the longitudinal valve axis 3, the guide strips 55 rest with a slight radial initial tension on the circumference of the valve end 5 of the fuel injection valve 1; the face ends 57 describe a circle, for instance. The guide strips 55 serve the purpose of exact centering of the gas enveloping sleeve 1 relative to the fuel injection valve 7.

It is also possible for the guide strips 55 to extend with their face end 57 approximately in the circumferential direction of the cylindrical part 9 or obliquely to the longitudinal valve axis 3 of the fuel injection valve 7.

In the direction remote from the bottom part 11 of the gas enveloping sleeve 1, the guide strips 55 are rounded with a rounded shoulder 59 bulging outward on each strip. This makes it easier to slip the gas enveloping sleeve 1 onto the valve end 5 of the fuel injection valve 7 and prevents damage to the circumference of the valve end 5 from the guide strips 55 while they are being slipped on.

At least one through opening 61 extending through the wall of the cylindrical part 9 is formed in the cylindrical part 9 of the gas enveloping sleeve 1. In the exemplary embodiments shown in FIGS. 1, 4 and 7, the cylindrical part 9 of the gas enveloping sleeve 1 has eight approximately quadrangular through openings 61, for example.

The exemplary embodiments shown in FIGS. 1–4 and 7 for instance have a gas enveloping sleeve 1 embodied by deformation of a metal sheet. To form the guide strips 55 and simultaneously form the through openings 61, three first edges 63, for instance, of an almost quadrangular tab-like segment, having a rounded shoulder 59 and forming a guide strip 55, are cut out of the wall of the cylindrical part 9, for example by stamping. In a second method step, the tab-like guide strips 55 are bent inward around a fixed second edge 65 of the segment, in such a way that the almost quadrangular guide strips 55 are oriented radially inward, and their face ends 57 extend parallel to the longitudinal valve axis 3; as a result, the almost quadrangular through openings 61 on the cylindrical part 9 are simultaneously opened. In this way, guide strips 55 and through openings 61 can be produced simply and economically.

Through the through openings 61, the gas enters axial gas guide conduits 67, defined in the radial direction by the wall of the cylindrical part 9 and the circumference of the valve end 5 of the fuel injection valve 7 and in the circumferential direction by two adjacent guide strips 55 each, and through an adjoining annular gas conduit 69, formed between the valve end 5 and the inner wall of the gas enveloping sleeve 1, which conduit likewise extends between the bottom part 11 and the perforated plate 41, the gas reaches the injection ports 43 of the valve end 5.

The bottom part 11 of the gas enveloping sleeve 1, for instance in a peripheral region 71 bordering the through openings 13, is plastically deformed in the direction of the longitudinal valve axis 3, extending obliquely to the valve end 5 of the fuel injection valve 7. In this way, a radially extending annular gas gap 77 that becomes narrower and immediately surrounds the through opening 13 is formed in the axial direction between a lower face end 73 of the perforated plate 41 and an upper face end 75 of the bottom part 11. The narrow annular gas gap 77 serves to deliver the gas to the fuel, injected through the injection ports 43 of the fuel injection valve 7, and to meter the gas. The gas delivered through the through openings 61, the gas guide conduits 67 each defined by two adjacent guide strips 55, and the annular gas conduit 69, flows through the narrow annular gas gap 77 to the through opening 13, where it meets the fuel injected through the injection ports 43. Because of the slight axial length of the narrow annular gas gap 77 in the direction of the longitudinal valve axis 3, the delivered gas is accelerated markedly and atomizes the fuel especially finely, so that the polluting engine emissions are reduced.

To obtain the most homogeneous possible fuel gas mixture, enabling optimal combustion, it is necessary for the quantity of gas meeting the injected fuel to match a predetermined set-point quantity. The axial length 79 of the narrow annular gas gap 77 must accordingly have a certain size. To adjust the quantity of gas flowing through the narrow annular gas gap 77, the gas enveloping sleeve 1 is slipped onto the valve end 5 of the fuel injection valve 7 far enough that the cylindrical part 9 of the gas enveloping sleeve rests, with a stop face end 83 remote from the bottom part 11 and formed for instance on a collar 81, on a stop face 85 of a radially outwardly pointing retaining shoulder 87 of the nozzle body 17. Next, the actual quantity of gas flowing through the narrow annular gas gap 77 is measured with a flow rate meter. In an ensuing method step, the set-point quantity of the delivered gas is adjusted by varying an axial spacing 89 between the stop face 85 of the retaining shoulder 87 and the peripheral region 71, immediately surrounding the through opening 13, on the upper face end 75 of the bottom part 11 of the gas enveloping sleeve 1; as a result, the axial length 79 of the annular gas gap 77 is varied until the measured actual quantity of gas matches the predetermined set-point quantity. The spacing between the stop face end 83 of the cylindrical part 9 and the peripheral region 71 of the upper face end 75 of the bottom part 11 is called the axial depth 91. In order to vary the axial spacing 89 between the stop face 85 of the retaining shoulder 87 and the peripheral region 71 on the upper face end 75 of the bottom part 11, the length of the cylindrical part 9 in the direction of the longitudinal valve axis 3 can be reduced, by removing material from the stop face end 83, until the axial depth 91 equals the necessary axial spacing 89. However, to vary the axial spacing 89, it is also possible to reduce the axial length of the bottom part 11, beginning at its upper face end 75, in the direction of the longitudinal valve axis 3, at least in the region of the narrow annular gas gap 77, by removal of material, for example. If the measured actual quantity of gas flowing through the annular gas gap 77 matches the predetermined set-point quantity when the cylindrical part 9 of the gas enveloping sleeve 1 rests with its stop face end 83 on the retaining shoulder 87 on the nozzle body 17, then the gas enveloping sleeve 1 and the valve end 5 are joined together.

The adjustment of the axial length 79 of the narrow annular gas gap 77 can also be done after the gas enveloping sleeve 1 has been fastened to the valve end 5; this can be done for instance, with simultaneous measurement of the actual quantity of gas flowing through the narrow annular gas gap 77, by plastically deforming the bottom part 11 of the gas enveloping sleeve 1 in the region of the narrow annular gas gap 77 in the direction of the longitudinal valve axis 3, until the measured actual quantity of gas matches the predetermined set-point quantity.

Figure 2:
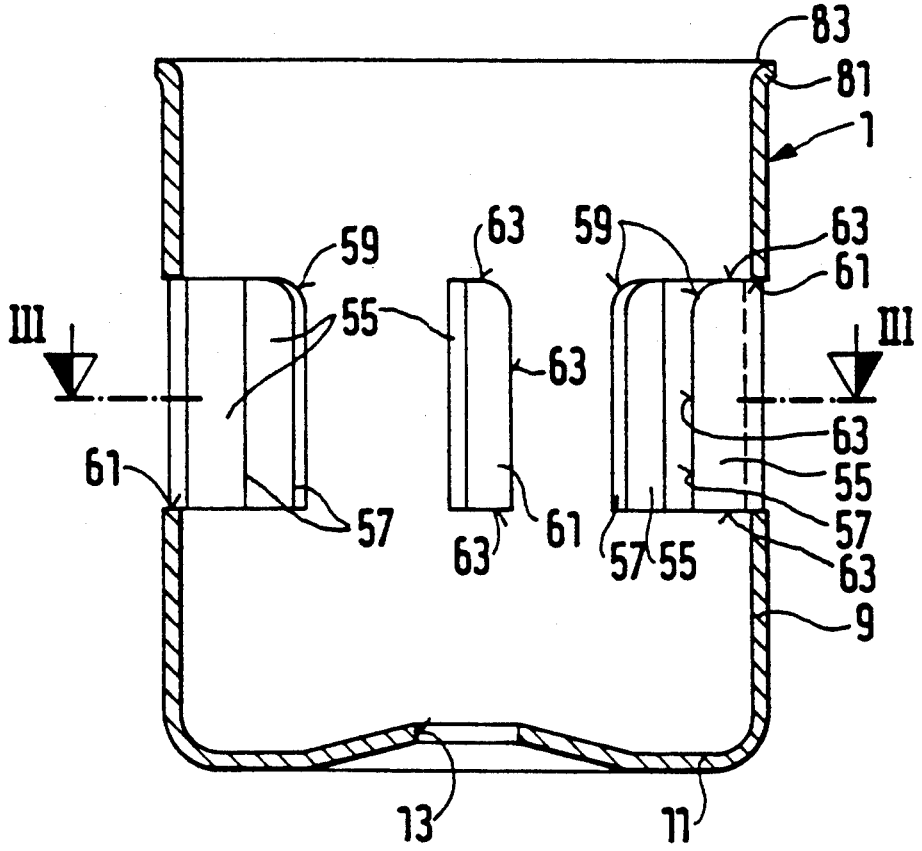
FIG. 2 shows a gas enveloping sleeve in accordance with the first exemplary embodiment.
Figure 3:
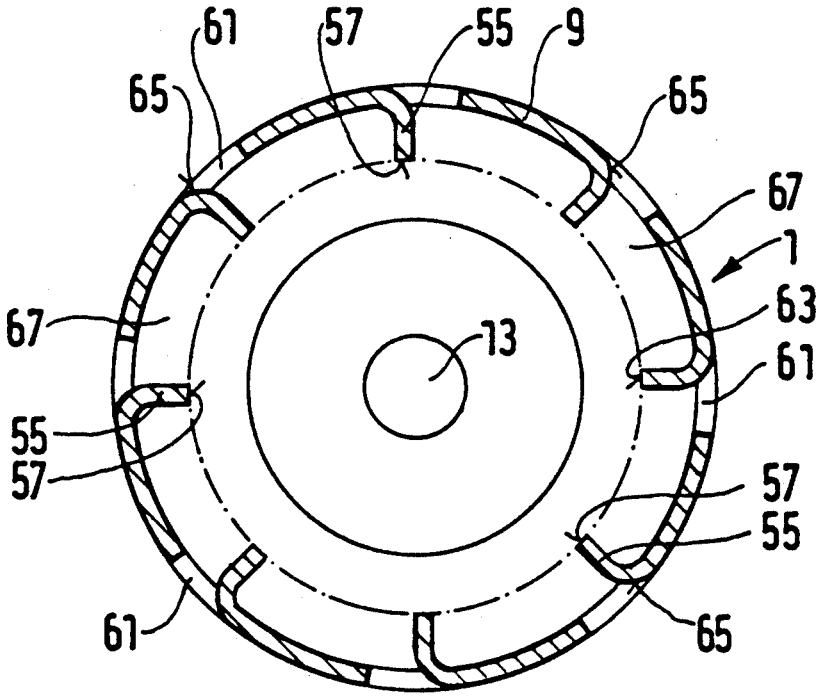
FIG. 3 is a section taken along the line III— III of FIG. 2.

In the first exemplary embodiment of the invention shown in FIGS. 1-3, the gas enveloping sleeve 1 resting on the stop face 85 is joined to the valve end 5 of the fuel injection valve 7 by means of individual spot welds 95 formed on the cylindrical part 9 of the gas enveloping sleeve.

The second exemplary embodiment, shown in FIG. 4, differs from the first only in the manner in which the gas enveloping sleeve 1 and the valve end 5 are joined. An annular groove 99 is formed on the circumference of the nozzle body 17, for instance beginning at the stop face 85. With the stop face end 83 of the collar 81, the cylindrical part 9 of the gas enveloping sleeve 1 rests on the stop face 85 of the nozzle body 17; the collar 81 is radially inwardly deformed, for instance at a plurality of points distributed over its circumference, in such a way as to form a crimped connection 101 between the gas enveloping sleeve 1 and the valve end 5 of the fuel injection valve 7. In this way, shifting of the gas enveloping sleeve 1 in the direction of the longitudinal valve axis 3 relative to the fuel injection valve 7 can be prevented securely and reliably. Advantageously, the gas developing sleeve can also be fastened to the valve end 5 of the fuel injection valve 7 by a pressing process, soldering, or adhesive bonding.

An upper annular groove 103, in which an upper sealing ring 105 is already disposed that serves to seal off the space between the fuel injection valve 7 and the wall of the receiving opening 47 is formed on the circumference of the fuel injection valve 7, above the inlet opening 52, in the fuel flow direction, of the gas delivery conduit 51 discharging into the valve receiving opening 47 of the intake tube 49. A retaining ring 109, which has a U-shaped cross section that opens radially outward, is disposed on the circumference of the cylindrical part, on the end 107 toward the bottom part 11, of the cylindrical part 9 of the gas enveloping sleeve 1 and thus below the inlet opening 52 of the gas delivery conduit 51 in the fuel flow direction. The retaining ring 109 is joined to the gas enveloping sleeve 1 on its end toward the bottom part 11, for instance by means of a fluid-tight weld seam 110. The U-shaped retaining ring 109, with its lateral arms 112 facing one another and extending outward radially, forms the side faces, and at right angles thereto, with its middle part 114 extending between the two arms 112 parallel to the longitudinal valve axis 3 and resting on the circumference of the cylindrical part 9, it forms the groove bottom of a lower annular groove 116. A lower sealing ring 118 is disposed in the lower annular groove 116 and serves to seal off the space between the gas enveloping sleeve 1 and the wall of the valve receiving opening 47.

Figure 5:
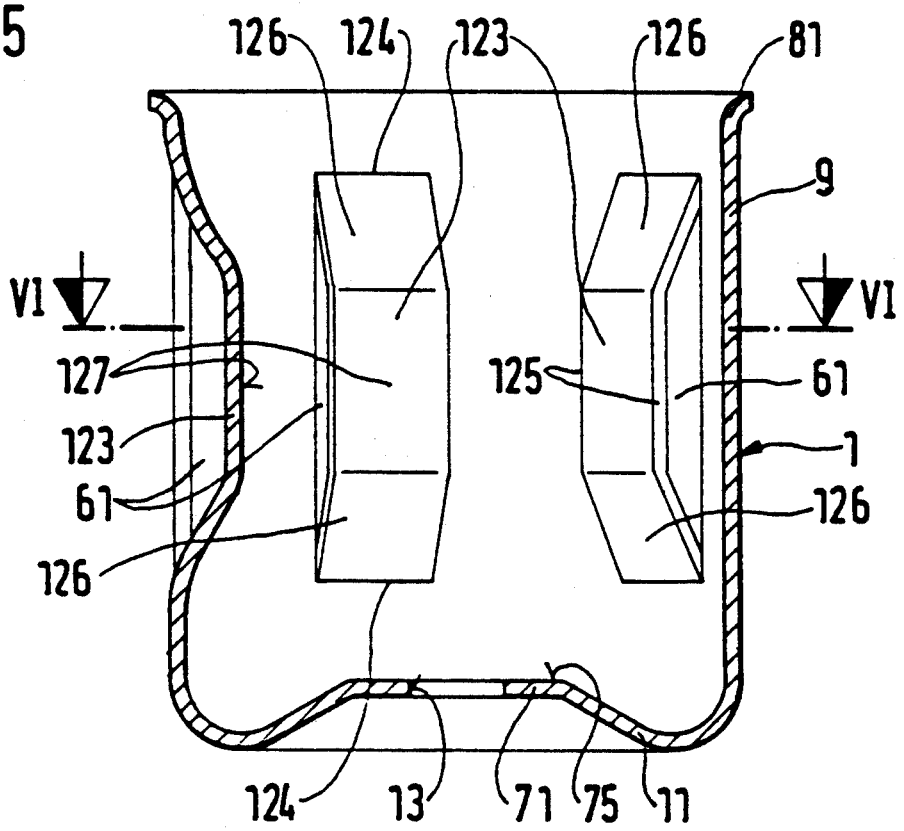
FIG. 5 shows a gas enveloping sleeve in a third exemplary embodiment of the invention.
Figure 6:
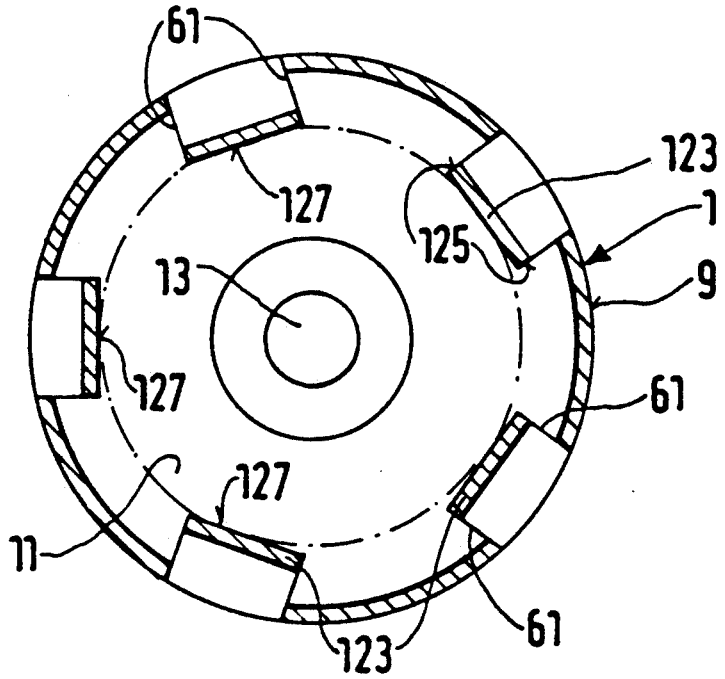
FIG. 6 is a section taken along the line VI—VI of FIG. 5.

FIGS. 5 and 6 show a gas enveloping sleeve in a third exemplary embodiment according to the invention; FIG. 6 is a section takes along the line VI—VI of FIG. 5. Elements that are the same and function the same are identified by the same reference numerals as in FIGS. 1-4. This third exemplary embodiment differs from the first two in having a different embodiment of the guide strips.

On its cylindrical part 9, the gas enveloping sleeve 1 has at least three, and in the third exemplary embodiment shown for instance has five, radially inwardly pointing rib-like guide strips 123, spaced apart from one another circumferentially by equal intervals, and ten, for example, through openings 61. The guide strips 123 and the through openings 61 of the gas enveloping sleeve 1 are formed by cutting through the wall of the cylindrical part 9 of the gas enveloping sleeve 1 and pressing inward radially to form the guide strips. Each of the rib-like guide strips 123 has two spaced-apart cut edges 25, extending parallel to one another and extending for example approximately in the direction of a longitudinal valve axis of a fuel injection valve, on the valve end of which the gas enveloping sleeve 1 can be installed, so that the guide strips 123 begin at the wall of the cylindrical part 9, transversely to the two cut edges 125 on their two ends 124. By pressing in the guide strips 123, two through openings 61, which serve to deliver the gas, are formed per guide strip, the through openings being immediately adjacent the cut edges 125.

However, it is also possible for the guide strips 123 to extend inclined obliquely relative to a longitudinal valve axis of a fuel injection valve, or for the guide strips to extend approximately circumferentially of the cylindrical part 9.

The guide strips 123 have middle face ends 127 oriented radially inward, which extend parallel to the longitudinal valve axis 3 of a fuel injection valve or to the cylindrical part 9 of the gas enveloping sleeve 1. Between the face ends 127 and the wall of the cylindrical part 9, immediately bordering on the face ends 127, outer transition zones 126 are formed, which extend in inclined fashion relative to the wall of the cylindrical part 9. In a device according to the invention that has a gas enveloping sleeve 1 in accordance with the third exemplary embodiment, the face ends 127 of the guide strips 123 serving to center the gas enveloping sleeve 1 relative to the fuel injection valve rest at least partly on the circumference of the valve end of the fuel injection valve, with a slight radial initial tension. The face ends 127 approximately describe a circle in the circumferential direction of the valve end.

However, although not shown, the guide strips 123 may also bulge outward, beginning at their ends 124, radially into the interior of the gas enveloping sleeve 1, in such a way that they have no edge extending parallel to the longitudinal valve axis 3.

FIG. 7 shows a fourth exemplary embodiment of a device for injecting a fuel gas mixture, in fragmentary form; elements that are the same and function the same are identified by the same reference numerals as in FIGS. 1–6. This fourth exemplary embodiment differs from the first exemplary embodiment shown in FIG. 1 substantially only in the manner of metering of the gas.

As in the first exemplary embodiment, as in the fourth exemplary embodiment as well, the bottom part 11 of the gas enveloping sleeve 1 is plastically deformed in the peripheral region 71 bordering the through opening 13, extending in the direction of the longitudinal valve axis 3 obliquely to the valve end 5 of the fuel injection valve 7. The gas enveloping sleeve 1 rests tightly on the lower face end 73 of the perforated plate 41 with an annular contact face end 130 oriented toward the valve end 5; this face end forms an end toward the valve end 5 of the oblique peripheral zone 71 and forms the circumferential rim of the through opening 13.

In the oblique peripheral zone 71 of the bottom part 11 of the gas enveloping sleeve 1, gas delivery openings 132, for instance six in number, are formed, penetrating the wall of the bottom part 11; relative to the longitudinal valve axis 3, they extend in inclined fashion in the fuel flow direction, remote from the valve end 5. The gas delivery openings 132 serve to meter the gas with respect to the fuel injected out of the injection ports 43 through the through opening 13. The size of the opening cross section and the number of gas delivery openings 132 affect the quantity and speed of the delivered gas. The position of the gas delivery openings 132 in the inclined peripheral zone 71 also makes it possible to vary the fuel atomization. Thus, in FIG. 7, gas delivery openings 132 are shown at various levels of the bottom part 11; the downstream gas delivered openings 132 for instance have smaller cross sections than those facing them. Arbitrary other opening cross sections for the gas delivery openings 132 are also possible besides the circular one shown in FIG. 7, for instance quadrangular, oval, or other shapes.

The gas meeting the injected fuel through the gas delivered openings 132, distributed over the bottom of the gas enveloping sleeve 1, produces an especially finely atomized fuel-gas mixture.

The gas enveloping sleeves 1 of the exemplary embodiments shown, formed for instance by mechanical deformation of sheet metal, may be made of metal sheets, for instance made of a stainless steel alloy or aluminum. However, it is also advantageous to make the gas enveloping sleeve by plastic injection molding or by pressure die-casting.

The device according to the invention for injecting a fuel-gas mixture, having the gas enveloping sleeve 1 that has radially inwardly pointing guide strips 55 resting on the circumference of the fuel injection valve 7 is not only capable of being manufactured simply and economically, but also permits exact centering of the gas enveloping sleeve 1 relative to the fuel injection valve 7.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A device for injecting a fuel-gas mixture, having a fuel injection valve that has at least one injection port, a cup-shaped gas enveloping sleeve that surrounds a valve end having the at least one injection port of the fuel injection valve at least partially axially with a cylindrical part (9) and at least partially radially with a bottom part (11), said sleeve has at least one through opening in its bottom part, the cylindrical part (9) has at least three radially inwardly pointing guide strips (55, 123), which rest on the circumference of the valve end (5).

2. A device as defined by claim 1, in which at least one through opening (61) is formed in the cylindrical part (9) of the gas enveloping sleeve (1).

3. A device as defined by claim 2, in which the guide strips (55, 23) and the through openings (61) on the cylindrical part (9) of the gas enveloping sleeve (1) are formed by cutting through the wall of the cylindrical part (9) and pressing the guide strips (55, 123) radially inward.

4. A device as defined by claim 3, in which each guide strip (123) is rib-like and has two cut edges (125) extending spaced apart from one another.

5. A device as defined by claim 4, in which the two cut edges (125) of each guide strip (123) extend approximately in the direction of a longitudinal valve axis (3).

6. A device as defined by claim 4, in which the rib-like guide strip have two ends and said rib-like guide strips (123) begin at the wall of the cylindrical part (9), transversely to the two cut edges (125) of their two ends (124).

7. A device as defined by claim 3, in which the guide strips (55) of the gas enveloping sleeve (1) are embodied in tab-like form and are bent radially inward in such a way that with face ends (57) the guide strips rest on the circumference of the valve end (5) of the fuel injection valve (7).

8. A device as defined by claim 1, in which the guide strips (55) are embodied as rounded in the direction remote from the bottom part (11).

9. A device as defined by claim 1, in which the gas enveloping sleeve (1) is fastened to the circumference of the valve end (5) by means of individual spot welds (95).

10. A device as defined by claim 1, in which the gas enveloping sleeve (1) is fastened to the circumference of the valve end (5) by means of a crimped connection (99, 101).

11. A device as defined by claim 1, in which a retaining ring (109), which has a U-shaped cross section that opens radially outward, is disposed on the circumference of the gas enveloping sleeve (1).

12. A device as defined by claim 1, in which a narrow annular gas gap (77) is formed in the axial direction between the valve end (5) of the fuel injection valve (7) and the bottom part (11) of the gas enveloping sleeve (1).

13. A device as defined by claim 1, in which the fuel injection valve (7) rests with its valve end (5) on the bottom part (11) of the gas enveloping sleeve (1), and that in the bottom part (11) at least one gas delivery opening (132) is formed, which extends in inclined fashion relative to the longitudinal valve axis (3) in the fuel flow direction.

14. A method for producing a device for injecting a fuel-gas mixture, having a fuel injection valve with at least one injection port which comprises forming a cup-shaped gas enveloping sleeve, which surrounds a valve end of the fuel injection valve at least partially axially with a cylindrical part and at least partially radially with a bottom part, forming guide strips (55, 123) in said cylindrical part (9) of the gas enveloping sleeve (1), by cutting all the way through various zones of the wall of the cylindrical part (9) and pressing them radially inward.

* * * * *